US007258360B2

(12) United States Patent
Vallet et al.

(10) Patent No.: US 7,258,360 B2
(45) Date of Patent: Aug. 21, 2007

(54) ALPINE SKI

(75) Inventors: William Vallet, Brezins (FR); Denis Redor, Saint Julien de Ratz (FR); Alain Zanco, Gillonnay (FR); Christian Alary, Saint Pierre de Chartreuse (FR)

(73) Assignee: Skis Rossignol S.A., Voiron (FR)

( * ) Notice: Subject to any disclaimer, the term of this patent is extended or adjusted under 35 U.S.C. 154(b) by 144 days.

(21) Appl. No.: 10/733,098

(22) Filed: Dec. 11, 2003

(65) Prior Publication Data

US 2004/0119264 A1 Jun. 24, 2004

(30) Foreign Application Priority Data

Dec. 16, 2002 (FR) ..... 02 15896
Dec. 19, 2002 (FR) ..... 02 16150

(51) Int. Cl.
*A63C 5/04* (2006.01)

(52) U.S. Cl. ..... 280/609; 280/601; 280/607; 280/608

(58) Field of Classification Search ..... 280/602, 280/809, 607–610, 818
See application file for complete search history.

(56) References Cited

U.S. PATENT DOCUMENTS

| | | | | |
|---|---|---|---|---|
| 3,549,162 | A | 12/1970 | Coutts | |
| 3,921,994 | A | 11/1975 | Locati | |
| 4,340,241 | A * | 7/1982 | Crocket | 280/609 |
| 4,449,735 | A * | 5/1984 | McDougall | 280/818 |
| 4,647,062 | A * | 3/1987 | McDougall | 280/607 |
| 4,951,960 | A * | 8/1990 | Sadler | 280/607 |
| 5,558,354 | A * | 9/1996 | Lion | 280/607 |
| 5,984,324 | A * | 11/1999 | Wariakois | 280/14.24 |
| 6,183,000 | B1 * | 2/2001 | Piatti | 280/610 |
| 6,241,272 | B1 * | 6/2001 | Hammerle | 280/609 |
| 6,499,758 | B1 * | 12/2002 | Fournier | 280/609 |
| 6,579,134 | B1 * | 6/2003 | Fiebing | 440/21 |
| 6,682,083 | B2 * | 1/2004 | Melcher | 280/14.26 |
| 6,837,512 | B2 * | 1/2005 | Long | 280/604 |

FOREIGN PATENT DOCUMENTS

| | | |
|---|---|---|
| AT | 238074 | 1/1965 |
| DE | 3 444 345 | 6/1986 |
| DK | 3702093 A * | 8/1988 |
| EP | 0 034 643 A1 | 9/1981 |
| EP | 1 297 869 A1 | 4/2003 |
| FR | 2 227 883 | 11/1974 |
| FR | 2 794 374 A1 | 12/2000 |

* cited by examiner

*Primary Examiner*—Christopher P. Ellis
*Assistant Examiner*—Vaughn T. Coolman
(74) *Attorney, Agent, or Firm*—Burr & Brown

(57) ABSTRACT

Alpine ski (1) having a sidecut (9) which has a radius smaller than 24 meters, wherein the front (10) and/or rear (18) ends have a cavity (11, 15) opening longitudinally at said end, the dimensions of the cavity (11, 15) allowing the deformation of said end when a transverse force is exerted at the front and/or rear contact lines so as to permit the inner and outer edges of the ski to move closer to one another.

8 Claims, 2 Drawing Sheets

ALPINE SKI

This application claims the benefit of French Application 02.15896, filed Dec. 16, 2002, and French Application 02.16150, filed Dec. 19, 2002, the entireties of which are incorporated herein by reference.

FIELD OF THE INVENTION

The invention concerns the field of sports involving sliding, more specifically that of the manufacture of alpine skis, that is to say, generally speaking, skis which make it possible to descend slopes performing turns. The invention relates more particularly to a ski of novel design having a sidecut which is variable as a function of the stress.

BACKGROUND OF THE INVENTION

Generally speaking, an alpine ski has several deformation capabilities. For instance, it is possible to determine a longitudinal flexural rigidity, which corresponds to the capability of the ski to bend when it is subjected to a vertical force. This bending is utilized in particular when the ski has to follow the changes in gradient of the run and also during turning.

A ski also has a torsional rigidity, which corresponds to its deformation capability when it is subjected to a torque applied about an axis essentially parallel to the ski. This deflection capability allows slight twisting of the ends of the ski.

Furthermore, a ski has a lateral flexural rigidity, which corresponds to its deformation capability when it is subjected to a lateral force. This lateral flexural rigidity is particularly small on existing skis in view of the fact that the width of a ski is markedly greater than its thickness.

There has thus far been a distinct trend toward producing skis which have a particularly deep sidecut and a small length. This sidecut forms on each side of the ski a curve which is comparable to an arc of a circle of which the radius of curvature is frequently smaller than about 24 meters. Generally speaking, the radius of curvature of this sidecut is defined by the radius of the circle passing through three points which are the two points of maximum width at the tip and at the tail and the point of minimum width at the underfoot.

This deep sidecut makes it possible when performing "cut turns" or "carving" to put the ski into a turn having a given radius, which depends therefore on the radius of curvature of this sidecut, minimizing the effects of sideslipping.

Performing carving requires the skier to lean laterally to a very considerable extent and to exert great forces during turning in order to cut into the snow to the maximum possible extent with the edge line. Such turns therefore result in high speed and are consequently beyond the scope of the average skier.

If the speed and the force exerted on the edge by the skier are insufficient, the edges cut into the snow only at the two points of maximum width of the sidecut and possibly over a small part of the sidecut. Outside these zones, the sidecut is in a state of sideslipping. The handling of the turn is therefore not truly optimum.

One object of the invention is to make it possible for the edge to bite over a major part of the sidecut, whatever the radius of curvature of the turn, the inclination of the ski in relation to the snow and the speed of the skier.

In the past, it has already been proposed to produce skis with special constructions which favor longitudinal deflection of certain parts of the ski, in particular the ends. For instance, in document AT 23 80 74, a ski has been described which has a front part which is split, so that each of these parts can move vertically independently of the other. This arrangement makes it possible to reduce the longitudinal flexural rigidity of each of the ends of the ski. However, the side profile of such a ski remains constant, in this case being rectilinear. Thus, as touched on above, when the ski is put into the turn, only a very limited zone of the edge bites into the snow, the remainder of the side profile sideslipping, or not being in contact with the snow.

A similar approach has also been proposed in document DE 34 44 345. The ski described in this document comprises a slit extending longitudinally from the tip to the tail in order to allow a reduction in the overall torsional rigidity. This ski also has reduced longitudinal flexural rigidity since, when the ski is inclined laterally in relation to the snow, only half of the ski comes into contact with the snow and therefore has a useful rigidity.

The design of the ski described in document FR 2 227 883 also aimed to achieve a similar goal.

A ski having a longitudinal slit opening at the end of the tip or of the tail has also been described in document FR 2794374. Means are provided for modifying the gap between the two portions separated by the slit and therefore for modifying the sidecut of the ski before use according to the capabilities of the skier and to the type of skiing performed.

A ski having a mechanical device located inside a housing formed inside the ski has also been described in document EP 1 297 869. This device is intended to increase the separation between the left and right edges when the ski bends.

SUMMARY OF THE INVENTION

The invention therefore relates to an alpine ski having a deep sidecut, that is to say one which has a radius smaller than about 24 meters. After the fashion of the ski described in document FR 2794374, the front and/or rear ends have a cavity opening longitudinally at this end.

According to the invention, this ski is characterized in that the dimensions of this cavity allow the deformation of this end when a lateral force is exerted at the front and/or rear contact lines so as to permit the left and right edges of the ski to move closer to one another. It will be noted that, under real conditions, forces are exerted on the ski not only laterally but also vertically, or more generally perpendicularly to the upper surface of the ski. Thus, the deformation observed on snow is generally such that the vertical stresses cause a displacement which has the effect of moving the right and left edges away from one another. However, the horizontal component (or more precisely that parallel to the running surface) of the forces to which the ski is subjected has the effect of moving the right and left edges closer to one another in a projection in the plane of the running surface of the ski.

In other words, the invention consists in separating the end of the ski into two parts therefore having a lower lateral flexural rigidity, so that these parts, which are free, can therefore each move closer to the longitudinal center plane of the ski when a stress is exerted transversely. The dimensions of the cavity are such that they permit the displacement of the two portions of the end. In this way, the sidecut of the ski can be deformed as a function of not only the topology of the run but also the forces exerted by the skier. This is because, when the ski is inclined on the edge, the extreme points of contact with the snow are close to the points of maximum width of the ski, which are themselves near the front and rear contact lines which are defined in a standardized manner.

It has been determined that, in order to achieve the desired deformation effect, it is appropriate to produce the ski so as to provide it with particular mechanical properties of rigidity. Thus, as far as the front end is concerned, the ratio:

$$C_{av} = \frac{Y_{av}}{F_{av} \cdot L_{av}^3}$$

must be greater than $0.3\times10^{-9}$, where $L_{av}$ and $Y_{av}$, expressed in millimeters, and $F_{av}$, expressed in Newtons, are determined on measurement of lateral deflection of the front part of the ski, during which measurement:

the ski is arranged on the side with its running surface vertical:

the ski is held clamped at a front fixed point located at a distance from the front end of the ski of 3/10 of the total length $L_n$ of the ski;

a force $F_{av}$ is exerted vertically on the edge of the ski at a point of application located at a distance of 120 millimeters from the front end of the ski, said point of application therefore being located at a distance $L_{av}=0.3\times L_n-120$, measured in millimeters, from the front fixed point;

the point of application undergoes a vertical displacement $Y_{av}$.

Similarly, as far as the rear end is concerned, the ratio:

$$C_{ar} = \frac{Y_{ar}}{F_{ar} \cdot L_{ar}^3}$$

must be greater than $0.3\times10^{-9}$, where $L_{ar}$ and $Y_{ar}$, expressed in millimeters, and $F_{ar}$, expressed in Newtons, are determined on measurement of lateral deflection of the rear part of the ski, during which measurement:

the ski is arranged on the side with its running surface vertical;

the ski is held clamped at a rear fixed point located at a distance from the rear end of the ski of 3/10 of the total length $L_n$ of the ski;

a force $F_{ar}$ is exerted vertically on the edge of the ski at a point of application located at a distance of 50 millimeters from the rear end of the ski, said point of application being located at a distance $L_{ar}=0.3\times L_n-50$, measured in millimeters, from the rear fixed point;

the point of application undergoes a vertical displacement $Y_{ar}$.

In practice, the ski can advantageously consist of two longitudinal elements arranged side by side and joined at the underfoot zone. The front or rear ends of these elements are then sufficiently separated to form the zone of the cavity which opens longitudinally and therefore permits the two elements to be moved closer to one another transversely under stress.

In practice, these two elements can advantageously be joined by a platform for mounting the binding.

The invention also includes variants in which the ski is not made from two separate elements but from one single element which has a monolithic underfoot zone and then, at the front, or at the rear, or at both, two distinct branches which are separated to form the characteristic cavity.

In practice, the cavity must allow a certain deformation under lateral stress. This cavity therefore corresponds to a modification of the structure of the ski at the end concerned and can be effected in different ways.

For instance, this cavity can be in the form of a complete absence of material. This cavity can also be filled with a filling material which is elastic and flexible and therefore allows each of the parts defining the cavity to be moved closer in the direction of the longitudinal center plane of the ski.

This filling makes it possible in particular to avoid snow passing through the cavity.

In another embodiment, this cavity can be delimited on the lower side by a deformable layer which constitutes the running surface and therefore connects the two parts defining the cavity.

In other words, the running surface can be continuous over the entire width of the ski and therefore fill in the lower face of the cavity so as to prevent the intrusion of snow. This running surface remains very easily deformable under transverse stress on account of its low rigidity. However, the volume located above the layer forming the running surface at the characteristic cavity is therefore either free from material or filled with an easily deformable material.

BRIEF DESCRIPTION OF THE DRAWINGS

The mode of embodying the invention and the advantages which derive from it will emerge clearly from the description of the embodiment which follows with reference to the accompanying figures, in which.

DETAILED DESCRIPTION OF THE INVENTION

Figure 1:
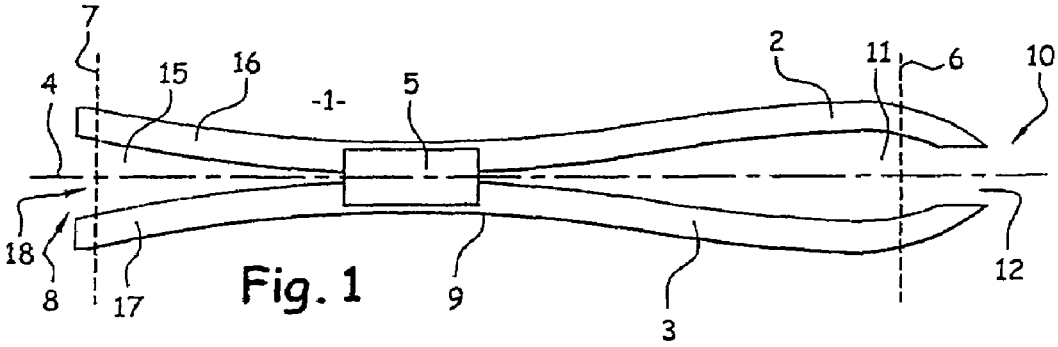
FIG. 1 is a top view of a ski according to the invention.

As already touched on, the invention relates to an alpine ski (1) which can be made according to the embodiment illustrated in FIG. 1. In that case, the ski (1) is made up of two elements (2, 3) which are essentially symmetrical about the longitudinally center plane (4) of the ski.

These two elements (2, 3) are connected by a platform (5) for raising the binding.

According to the invention, the ski comprises a cavity (11) which opens (12) at the front end (10) of the ski. At the rear end likewise, the ski (1) comprises a cavity (15) formed by the divergent portions (16, 17) of the elements (2, 3). This cavity (15) opens at the rear (18) of the ski (1).

Figure 2:
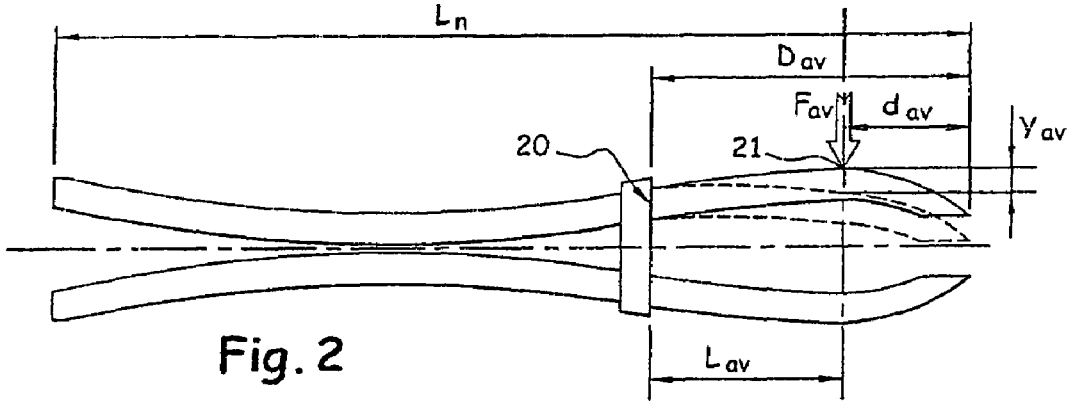
FIGS. 2 and 3 are top views of the ski in FIG. 1 showing the lateral deformation of the front and, respectively, rear end.
Figure 3:
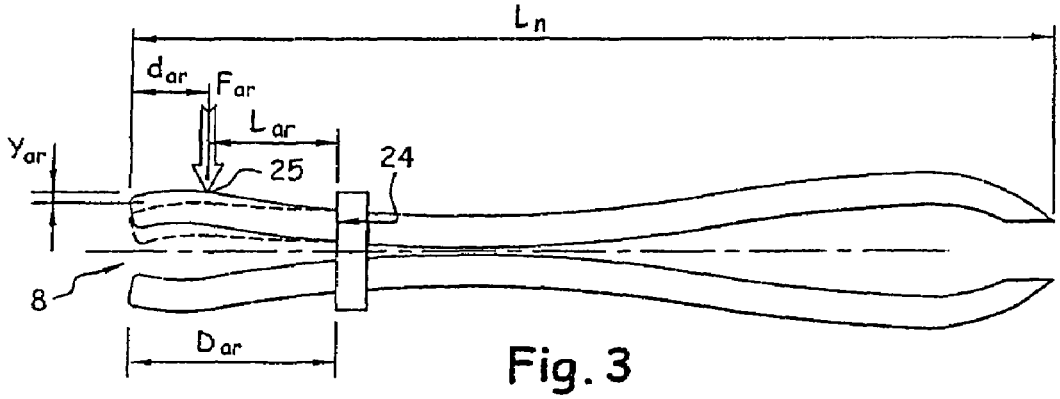

The ski thus has a deformation capability under lateral stress which is illustrated in FIGS. 2 and 3 at the front and, respectively, the rear of the ski.

This deformation can be measured by a lateral flexural rigidity test which is illustrated in FIG. 2.

The ski is thus arranged on the side with its running surface vertical. The ski (1) is held clamped at a front fixed point (20) located at a distance $D_{av}$ measured from the front end (10) of the ski of 3/10 of the total length $L_n$ of the ski.

A force $F_{av}$ is exerted vertically on the edge of the ski at a point of application (21) located at a distance $d_{av}$ of 120 millimeters from the front end (10) of the ski (1). This point of application is therefore located at a distance $L_{av}$ of $0.3 \times L_n - d_{av}$ from the front fixed point (20).

The displacement $Y_{av}$ in the vertical direction of the point of application (21) of the force F is then measured. If the curve indicating the displacement observed as a function of the force exerted is not completely linear, in particular in the zone corresponding to small forces, the forces and displacement are then measured in a differential manner in a linear portion of this curve.

Good results for behavior on snow are observed when the lateral flexural rigidity, defined by the criterion $$C_{av} = \frac{Y_{av}}{F_{av} \cdot L_{av}^3},$$

is greater than $0.3 \times 10^{-9}$, with $Y_{av}$ and $L_{av}$ expressed in millimeters and $F_{av}$ expressed in Newtons. In practice, this criterion value can be greater than $1 \times 10^{-9}$ or even $1.2 \times 10^{-9}$.

The same type of measurement can be performed at the rear end, as illustrated in FIG. 3.

The ski is then likewise held clamped at a fixed point located at a distance $D_{ar}$ measured from the rear end (8) of the ski equal to 3/10 of the total length $L_n$ of the ski.

A force $F_{ar}$ is exerted vertically on the edge of the ski at a point of application (25) located at a distance of 50 millimeters from the rear end (8) of the ski. The point of application (25) is therefore located at a distance $L_{ar} = 0.3 \times L_n - d_{ar}$ from the rear fixed point (24). The vertical displacement $Y_{ar}$ of the point of application (25) of the force $F_{ar}$ is likewise measured.

In practice, good results as far as the lateral flexural rigidity is concerned are obtained when the criterion $$C_{ar} = \frac{Y_{ar}}{F_{ar} \cdot L_{ar}^3},$$

is greater than $0.3 \times 10^{-9}$, with $Y_{ar}$ and $L_{ar}$ expressed in millimeters and $F_{ar}$ expressed in Newtons. In fact, the value of this criterion can be above $1 \times 10^{-9}$ or even $1.5 \times 10^{-9}$, depending on the flexibility desired.

It can thus be seen that the lateral deformation of the ski is particularly great and bears no relation to existing skis, for which the same criteria rare in the region of $0.15 \times 10^{-9}$.

When the force exerted, whether at the front or at the rear, is of the order of 100 Newtons, the ratio of the displacement Y over the total length $L_n$ of the ski is greater than 0.0015. In practice, this means that the deformation may reach virtually 1 centimeter at the front and rear ends.

Figure 4:
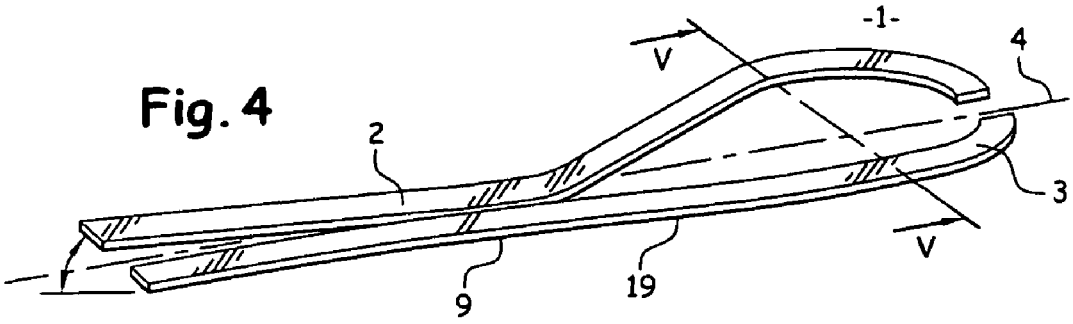
FIG. 4 is a basic perspective view of the ski in FIG. 1 shown in a situation where the ski is stressed in a turn to the right.

In practice, this considerable deflection under lateral stress has the effect as illustrated in FIG. 4 that the ski (1) can have a sidecut (9) which changes as a function of the stress. Thus, in the case illustrated in FIG. 4, which is exaggerated as far as the deformations are concerned in order to facilitate comprehension, it can be seen that the element (3) is relatively deformed, having moved closer to the longitudinal center plane (4) of the ski, so that the edge line (19) in contact with the snow has a greatly increased radius of curvature. It can be seen that most of the edge of the element (3) comes into contact with the snow, with the exception of the end forming the raised tip. This edge will therefore bite into the snow over a large part of its length and therefore allows safer handling of the turn. This characteristic deformation can be achieved whatever the angle of inclination of the ski in relation to the snow, that is to say as a function of the gradient of the run and the position of the skier.

Figure 5:
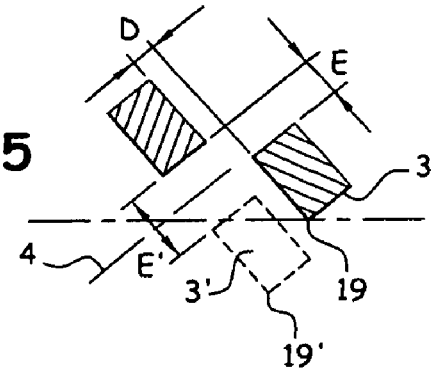
FIG. 5 is a section essentially at the front contact line of the ski in FIG. 4.

As illustrated in FIG. 5, this deformation has the effect primarily of moving the element (3) closer in the direction of the longitudinal center plane (4). In FIG. 5, the shape in broken lines (3'), represents the element (3) in a symmetrical configuration with the element (2) in relation to the longitudinal center plane (4) in a situation in which it is not stressed. The distance E separating the two elements in a horizontal plane is therefore smaller than the distance E' corresponding to the situation in which the element is not stressed. Likewise, the edge (19) is therefore offset in relation to the position (19') it would occupy without stresses. The element (3) is also deformed in a longitudinal deflection direction, while the element (2) remains virtually undeformed. The two elements, which are not both in contact with the surface of the snow, are thus offset in relation to one another, More precisely, the element (3) coming into contact with the snow is offset upward by a distance D in a direction perpendicular to the plane of the running surface.

It has been realized that the longitudinal flexural rigidity of each element (measured with the ski flat on its running surface and subjected to a load perpendicular to its running surface) must correspond essentially to that of a conventional ski, so that the overall longitudinal flexural rigidity of the ski is of the order of twice that of a monolithic ski. This is because, when the ski is on the edge, only one element bends and its great rigidity is therefore necessary for the good behavior of the ski.

The lateral displacements can be variable depending on the structures used.

In practice, as touched on already, the characteristic cavity is made at the front and/or rear ends of the ski and corresponds to a structural cavity, which means that at this cavity the ski has a structure which has very low strength and is different from that of the rest of the ski, in particular in its lateral portions formed by the elements (2, 3).

Figure 6:
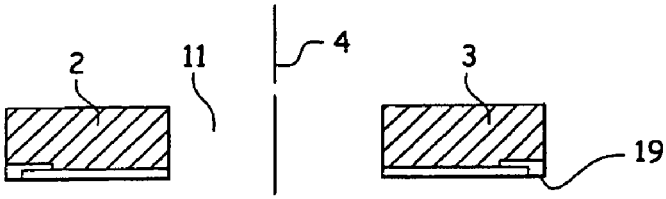
FIGS. 6 to 8 are sectional views essentially at the front contact line of three variant embodiments.
Figure 7:
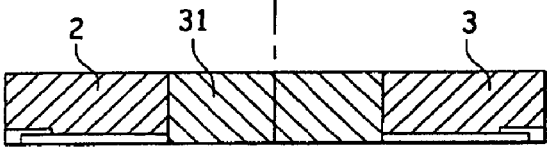

This cavity can thus be completely free from material, as illustrated in FIG. 6. As illustrated in FIG. 7, it can be filled with an elastic material (31) such as a, for example closed-cell, foam rubber.

Figure 8:
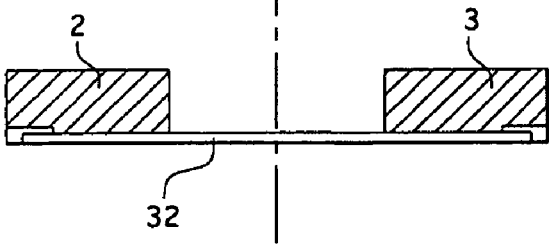

In a variant illustrated in FIG. 8, this cavity can receive the running surface (32) of the ski, which extends from one lateral element (2) to the other (3). The material used to make the running surface is relatively flexible since it is generally polyethylene.

This material opposes only very slightly the moving of one of the elements closer toward the longitudinal center plane (4) of the ski.

It emerges from the above that the ski according to the invention has a structure which is entirely innovative in the sense that it permits lateral deflection under transverse stress which cannot be compared with existing skis.

This therefore allows most of the length of the edge to bite into the snow and therefore facilitates the handling of the turn, whatever the radius of curvature the skier wishes to give the turn and the inclination of the ski in relation to the snow.

The invention claimed is:

1. An alpine ski having a sidecut which has a radius smaller than 24 meters, said ski comprising:

two longitudinal elements extending from at least one of front and rear ends of said ski to at least a position in an underfoot zone of said ski; and a cavity formed between said longitudinal elements opening longitudinally at said end, dimensions of said cavity allowing the deformation of said end such that left and right edges of said ski move closer to one another when a lateral force is exerted at contact portions of the sidecut; and wherein said left and right edges are maintained at a constant distance apart from one another in at least a portion of said underfoot zone.

2. The alpine ski as claimed in claim 1, wherein the cavity receives an elastic filling material.

3. The alpine ski as claimed in claim 1, wherein a ratio of displacement in lateral deflection ($Y_{av}$, $Y_{ar}$) divided by the total length $L_n$ of the ski is greater than 0.0015 when a 100 Newton force F is exerted.

4. The alpine ski as claimed in claim 1, wherein the cavity is open along upper and lower surfaces of said ski from said end to said underfoot zone.

5. An alpine ski having a sidecut which has a radius smaller than 24 meters, said ski comprising:

two longitudinal elements extending from at least one of front and rear ends of said ski to at least a position in an underfoot zone of said ski;

a cavity formed between said longitudinal elements opening longitudinally at said end, dimensions of said cavity allowing the deformation of said end such that left and right edges of said ski move closer to one another when a lateral force is exerted at contact portions of the sidecut; and a platform joined against an upper surface of said longitudinal elements in at least said underfoot zone to close at least a portion of said cavity and to maintain a constant size of said cavity in said underfoot zone.

6. The alpine ski as claimed in claim 5 wherein the cavity is open along upper and lower surfaces of said ski from said end to said underfoot zone.

7. An alpine ski having a sidecut which has a radius smaller than 24 meters, said ski comprising:

two longitudinal elements extending from each of front and rear ends of said ski to at least a position in an underfoot zone of said ski;

a cavity formed between said longitudinal elements of each end opening longitudinally at said end, dimensions of said cavity allowing the deformation of said end such that left and right edges of said ski move closer to one another when a lateral force is exerted at contact portions of the sidecut; and wherein said left and right edges are maintained at a constant distance apart from one another in at least a portion of said underfoot zone.

8. The alpine ski as claimed in claim 7, wherein the cavity is open along upper and lower surfaces of said ski from said end to said underfoot zone.

* * * * *